United States Patent [19]

Weyler

[11] Patent Number: 4,848,967

[45] Date of Patent: Jul. 18, 1989

[54] LOAD-TRANSFER SYSTEM FOR MATING AN INTEGRATED DECK WITH AN OFFSHORE PLATFORM SUBSTRUCTURE

[75] Inventor: Michael E. Weyler, Houston, Tex.

[73] Assignee: Exxon Production Research Company, Houston, Tex.

[21] Appl. No.: 140,691

[22] Filed: Jan. 4, 1988

[51] Int. Cl.[4] ..... E02D 25/00

[52] U.S. Cl. ..... 405/204; 405/195; 405/203; 405/209

[58] Field of Search ..... 405/204, 203, 195, 209, 405/208, 196

[56] References Cited

U.S. PATENT DOCUMENTS

| | | | |
|---|---|---|---|
| 2,907,172 | 10/1959 | Crake | 405/209 |
| 4,069,680 | 1/1978 | Erler | 405/195 |
| 4,222,683 | 9/1980 | Schaloske et al. | 405/203 |
| 4,242,011 | 12/1980 | Karsan et al. | 405/204 |
| 4,413,926 | 11/1983 | Ninet | 405/204 |
| 4,436,454 | 3/1984 | Ninet | 405/204 |
| 4,655,641 | 4/1987 | Weyler | 405/204 |
| 4,662,788 | 5/1987 | Kypke et al. | 405/204 |

FOREIGN PATENT DOCUMENTS

| | | | |
|---|---|---|---|
| 2165188 | 4/1986 | United Kingdom | 405/204 |

OTHER PUBLICATIONS

Model Testing the Offshore Installation of an Integrated Deck by R. G. Standing, G. E. Jackson and G. J. White, 8 pages, published at the 6th International Symposium on Offshore Mechanics and Arctic Engineering, (OMAE), Houston, Texas, Mar. 1987.

*Primary Examiner*—Dennis L. Taylor
*Attorney, Agent, or Firm*—T. N. Hathaway

[57] ABSTRACT

A load transfer system and method for its use for mating an integrated deck structure onto an offshore platform substructure at an offshore location is disclosed. The load transfer system utilizes a probe extending downwardly from the integrated deck and adapted to mate with the substructure, and a shock-load absorbing system having a first spring with a linear compressive response and a second spring with a variable compressive response mounted in series between the integrated deck and the probe.

34 Claims, 4 Drawing Sheets

LOAD-TRANSFER SYSTEM FOR MATING AN INTEGRATED DECK WITH AN OFFSHORE PLATFORM SUBSTRUCTURE

FIELD OF THE INVENTION

The present invention relates generally to offshore petroleum drilling and producing operations. More particularly, it relates to apparatus and methods for mating integrated deck structures with offshore platform substructures.

BACKGROUND OF THE INVENTION

Integrated deck structures are prefabricated decks designed to be installed as a unit onto a platform substructure at an offshore location. These substructures provide a framework for anchoring and supporting the deck, and are normally either fixed or floating. Fixed substructures are attached to the ocean floor, typically by means of a gravity base or a piled foundation. Floating substructures are sufficiently buoyant that their own weight, and that of an integrated deck structure placed on the substructure, is carried by the buoyancy. Floating substructures are typically maintained in position by an anchoring system.

When mating an integrated deck structure with an offshore platform substructure, the deck may be transported to the substructure by means of a barge. For most applications, a single barge may be used; however, in mounting deck structures onto single leg substructures such as those used in arctic climates, multiple barges may be required. Typically, the barge is positioned proximate the substructure and ballasted to lower the integrated deck structure onto the substructure and transfer its load thereto. Once the integrated deck is in place with the load transferred to the substructure, the barge may be disengaged and taken back to shore.

Major complications can arise during this mating procedure, due in large part to the significant relative vertical motion between the integrated deck and the substructure as the deck i transferred onto the substructure. The shock of the initial contact between the integrated deck structure and the substructure can cause appreciable damage to both structures and result in unwanted delays and expense to repair or replace any equipment so damaged. The larger the moving loads, the greater the possibility and severity of damage due to shock loads at impact.

Prior art techniques for reducing the shock loads primarily involve placing some form of spring system between the integrated deck structure and the substructure. One approach to this problem is illustrated by the system described in U.S. Pat. No. 4,413,926, issued on Nov. 8, 1983 to Ninet, in which an elastomeric spherical shock absorber is placed between the integrated deck structure and a probe which extends below the integrated deck structure. The probe is lowered into a receptacle in an upwardly extending leg of the substructure, and the integrated deck structure is then lowered onto the probe. As the load of the integrated deck structure is transferred to the probe and hence to the upwardly extending leg of the substructure, the spherical shock absorber absorbs the impact load and is squashed. A similar apparatus described in U.S. Pat. No. 4,436,454, issued Mar. 13, 1984 also to Ninet, substitutes an elastomeric block as a damping unit in place of the elastomeric sphere previously described.

An alternative approach to this problem is that illustrated by the system described in U.S. Pat. No. 4,222,683, issued on Sept. 16, 1980 to Schaloske et al. Schaloske et al., in one embodiment, describe an apparatus in which the desired shock absorbing function is performed by springs mounted between a downwardly extending leg of the integrated deck structure and a guide ring about the lower end of the leg. These springs absorb the shock of impacts between the guide ring and an upwardly extending leg of the substructure. The springs and guide ring are supported from the downwardly extending leg on extended hydraulic cylinders. The hydraulic cylinders are subsequently retracted to relieve the springs from compression after the integrated deck is in place on the substructure.

Another approach to this problem, also involving a hydraulic cylinder, is that illustrated in a paper entitled *Model Testing the Offshore Installation of an Integrated Deck* by R. G. Standing et al, published at the 6th International Symposium on Offshore Mechanics and Arctic Engineering (OMAE), Houston, Texas, March 1987. This particular system is described as having hydraulic cylinders which are activated to insert stab pins from the downwardly extending legs of the integrated deck into sleeves in the upwardly extending legs of the substructure, thereby eliminating relative horizontal motion between the deck and the substructure. The deck is then lowered onto the substructure and the impact loads are absorbed by a vertical elastomer in the upwardly extending leg of the substructure.

It will be appreciated that the above-discussed prior art systems rely on linearly-responsive shock absorbers or springs to absorb the impact loads. These prior art systems consequently suffer from a serious shortcoming stemming from the dual function of such springs. The springs must, first, absorb the load impact and, second, assume the full load of the integrated deck structure. A very soft linear spring would provide the ideal minimal shock loading at impact. But such a soft linear spring takes a prohibitively large amount of deflection before assuming the full load. A very stiff linear spring, on the other hand, would assume the full load with only a short deflection, but would result in prohibitively severe shock loading at impact. Ideally, a spring system for use in mating an integrated deck structure with an offshore substructure would be very soft at impact and then would smoothly transition to a very stiff response as compression proceeded and it assumed the load of the structure, i.e. the spring would be non-linear in its response. The present invention is aimed at providing a non-linear spring system having these characteristics and consequently overcoming the shortcomings of the prior art systems.

SUMMARY OF THE INVENTION

The present invention is a load-transfer system and method for its use for mating an integrated deck structure onto an offshore platform substructure at an offshore location. The system, in its overall concept, comprises an integrated deck structure, an offshore platform substructure, and at least one probe extending downwardly from the deck structure with a bearing surface on its lower end adapted to mate with a corresponding bearing surface on the substructure. A linear spring and a hydraulic cylinder are mounted in series between the upper end of the probe and the integrated deck structure. The system also includes means for conducting a compressible gas into and out from the hydraulic cylinder, and means for conducting a hydraulic fluid into and out from the hydraulic cylinder. Control of both the compressible gas pressure and the amount of the hydraulic fluid in the hydraulic cylinder allows the linear spring and hydraulic cylinder to function together as a non-linear shock absorber which is initially very soft, to minimize shock loading at impact, but which can be adjusted to become very stiff as it compresses and assumes the full load of the integrated deck structure.

In the operation of the preferred load-transfer system, the integrated deck structure is transported to the offshore platform substructure by means of a barge. The barge is positioned so that the load bearing surfaces on the probe and the substructure are in approximate vertical alignment. A compressible gas, preferably air, is conducted into the hydraulic cylinder in order to lower the load bearing surface on the lower end of the probe into contact with the corresponding load bearing surface on the substructure. Once the load bearing surfaces are in contact, a hydraulic fluid is pumped into the hydraulic cylinder, increasing the pressure of the compressible gas therein. The barge is simultaneously ballasted to transfer at least a portion of the load of the integrated deck structure to the substructure. Once the desired portion of the load of the integrated deck has been transferred to the substructure, drop block assembles are lowered to disengage the barge from the integrated deck structure. The barge is then returned to shore.

In a preferred embodiment of the invention, the integrated deck structure has a plurality of downwardly extending legs and the substructure has a corresponding plurality of upwardly extending legs. Each pair of corresponding downwardly and upwardly extending legs has a non-linear shock absorber, as described above, associated therewith. After the deck structure has been completely removed from the barge, the downwardly extending legs on the integrated deck structure are brought into contact with the corresponding upwardly extending legs on the substructure by draining hydraulic fluid from the hydraulic cylinders. The legs can then welded together for additional rigidity.

These and other features and advantages of the present invention will be more readily understood by those skilled in the art from a reading of the following detailed description with reference to the accompanying drawings.

DETAILED DESCRIPTION OF THE PREFERRED EMBODIMENT

Figure 1:
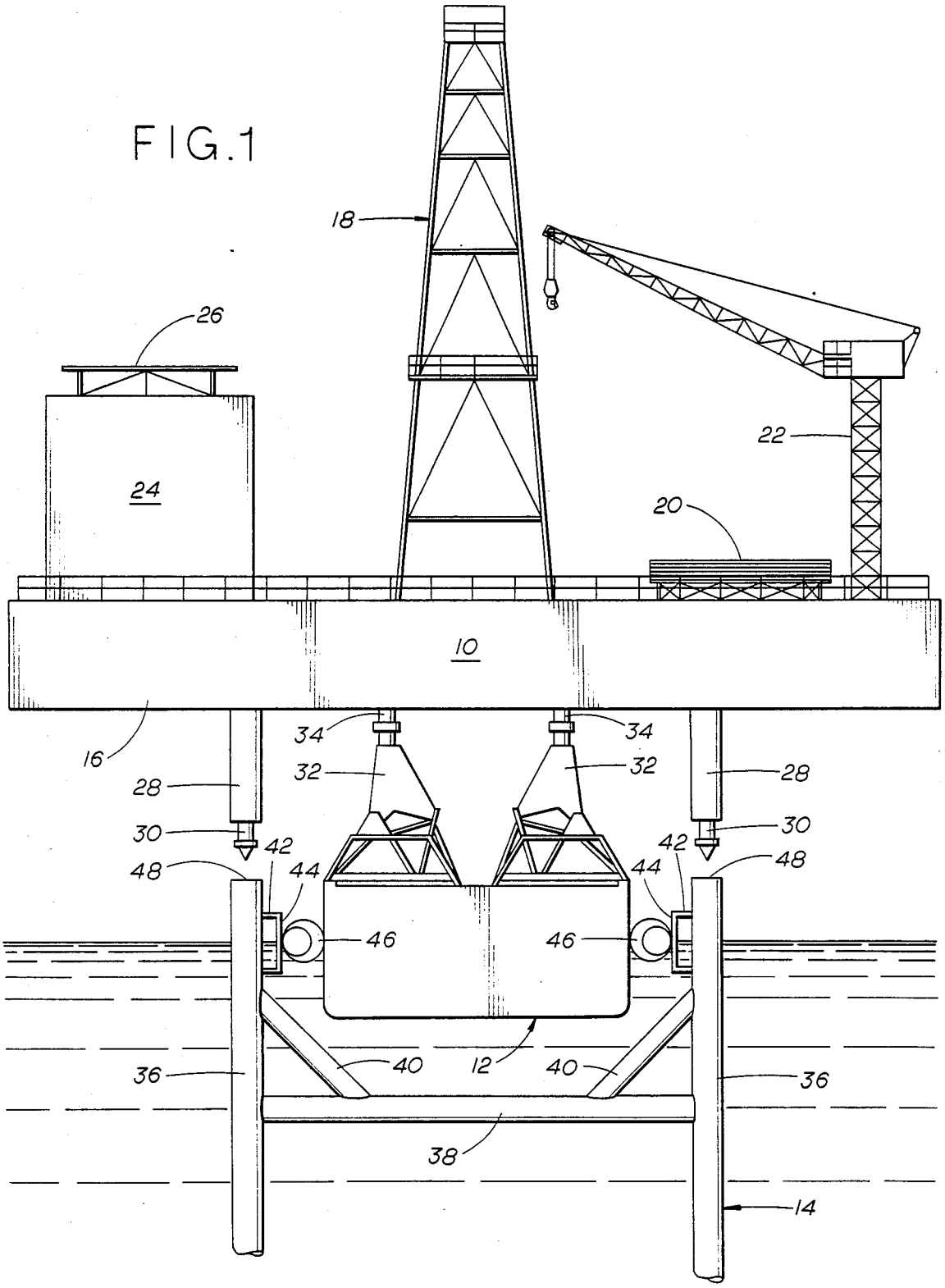
FIG. 1 is an elevational view of an embodiment of the inventive offshore load-transfer system showing an integrated deck structure on a barge in place for mating with an offshore platform substructure.

FIG. 1 illustrates an offshore mating operation with a load-transfer system embodying the present invention. More particularly, FIG. 1 shows an integrated deck structure 10 on a barge 12 in place for mating with an offshore platform substructure 14.

Integrated deck structure 10 is preferably a prefabricated unit constructed onshore to be transported by barge 12 and mated offshore with substructure 14. As depicted in FIG. 1 for purposes of illustration but not by way of limitation, integrated deck structure 10 includes a platform deck 16 having a derrick 18, storage area 20, crane 22, and quarters 24 with a helipad 26 mounted thereon.

Integrated deck structure 10 also has one or more downwardly extending legs 28 mounted beneath platform 16 with shock load absorbing means 30 attached to the base of each leg 28. Each downwardly extending leg 28, in a typical application, may have an outside diameter of about 48 inches and a maximum load capacity of about 3 million pounds. Shock load absorbing means 30 is provided both to absorb the shock load of the transfer of integrated deck structure 10 from barge 12 to substructure 14 and to assume the load of integrated deck structure 10, as is detailed below.

Integrated deck structure 10 is initially mounted on barge 12 for transportation to offshore substructure 14. Barge 12 may be any suitable vehicle, well known to those skilled in the art, for transporting integrated deck structure 10 to such an offshore location. As depicted in FIG. 1, barge 12 is of a conventional construction provided with drop block assemblies 32 for carrying integrated deck structure 10 to substructure 14. Integrated deck structure 10 is provided with load bearing pads 34 which rest on drop block assemblies 32. Once in place proximate substructure 14, barge 12 is ballasted to transfer the load of integrated deck structure 10 to substructure 14, drop block assemblies 32 are detached from load bearing pads 34, and barge 12 is returned to shore.

Substructure 14 is provided as an offshore mount for integrated deck structure 10. Substructure 14 may be fixed or floating, and its general construction may be any one of a number of well known fixed or floating substructure arrangements. As shown in FIG. 1, substructure 14 comprises one or more upwardly extending legs 36 supported therebetween by horizontal strut 38 and angular struts 40. As they are ordinarily designed to correspond to and be matable with downwardly extending legs 28, upwardly extending legs 36 also may, for a typical application, have an outside diameter of about 48 inches and a maximum load capacity of about 3 million pounds. Substructure 14 is also provided with a fender assembly 42 for use in positioning barge 12 during the mating operation. As shown in FIG. 1, fender assembly 42 comprises a truss 44 mounted on each of the legs 36 to which a bumper 46 is attached. As is well known in the art, bumper 46 can be of inflatable or other construction as necessary to position barge 12 in approximate alignment for the mating operation. Each leg 36 is provided with a receptacle 48 adapted to receive the lower end of shock load absorbing means 30.

Figure 2:
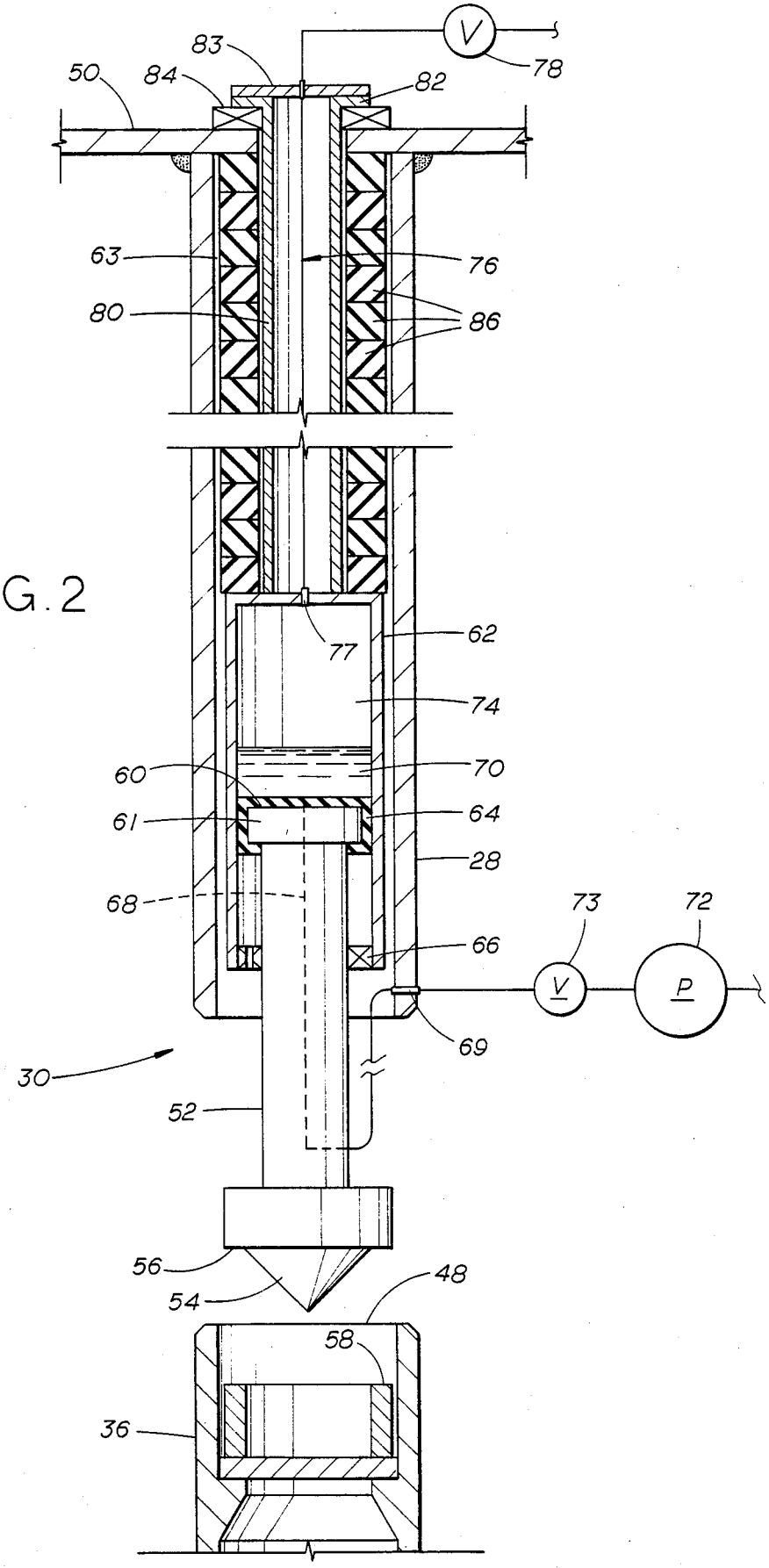
FIG. 2 is an elevational view in cross-section of the shock-load absorbing means of the inventive load transfer system prior to the mating procedure.

Referring now to FIG. 2, shock load absorbing means 30 is shown mounted inside downwardly extending leg 28, which is preferably cylindrical. The upper end of downwardly extending leg 28 is welded to the underside of deck 50, which in turn is a structural member of platform deck 16 (see FIG. 1).

Shock load absorbing means 30 comprises probe 52 which has an upper end and a lower end, hydraulic cylinder 62, and linear spring 63. Linear spring 63 has a linear compressive response and hydraulic cylinder 62 provides a spring with a variable compressive response. On the lower end of probe 52 is mounted stabbing point 54 which has a load bearing surface or ring 56 about its perimeter. Upwardly extending leg 36 of substructure 14 is provided with a cylindrical receptable end 48 having a sufficiently large inner diameter to receive stabbing point 54 with load bearing ring 56. Mounted within receptacle end 48 is a tubular bearing ring 58, which is designed as a load bearing surface to correspond to load bearing ring 56 and transmit loads from probe 52 to leg 36.

Probe 52 has an upper end 60 which is positioned within hydraulic cylinder 62 so that the lower end of probe 52 with stabbing point 54 extends downwardly beyond the lower end of hydraulic cylinder 62. The upper end of probe 52 is provided with a shoulder 61 which extends radially beyond the diameter of the shaft of probe 52. The upper end of probe 52 is also provided with a conventional seal 64 which forms a slideable hydraulic seal between the upper end of probe 52 and the inner wall of hydraulic cylinder 62. In this manner, the upper end of probe 52 functions as a piston in hydraulic cylinder 62. At the lower end of hydraulic cylinder 62 is mounted bushing 66, through which the shaft of probe 52 slides axially. Bushing 66 centers probe 52 in correct axial alignment with respect to hydraulic cylinder 62 within downwardly extending leg 28. In addition, bushing 66 acts as a stop which reacts with seal 64 to prevent probe 52 from travelling or falling out of engagement with hydraulic cylinder 62. Hydraulic cylinder 62 and probe 52 are arranged to permit probe 52 to extend to a position in which the lower end of probe 52, with stabbing point 54 and load ring 56, is extended below the lower end of downwardly extending leg 28, as will be detailed below.

Probe 52 is also provided with an hydraulic line 68 which passes laterally into and then longitudinally through its shaft, and which extends through its upper end into hydraulic cylinder 62. Hydraulic line 68 is adapted to conduct an incompressible hydraulic fluid into and out from hydraulic cylinder 62. With reference to FIG. 2, a column of a hydraulic fluid 70 is shown filling the lower portion of hydraulic cylinder 62. As used herein, the term "hydraulic fluid" is intended to include any suitable substantially incompressible fluid, including, for example, synthetic hydraulic fluid or water, either salt or fresh. In the preferred embodiment illustrated, hydraulic line 68 laterally exits the side of the shaft of probe 52 and is routed through a suitable passageway 69 in the side of downwardly extending leg 28 so as to prevent it from being crushed between the ends of the legs in the operation of the system. Hydraulic line 68 may in this embodiment be preferably fabricated of flexible material so that it can accommodate relative movement between probe 52 and leg 28. It will be obvious to those skilled in the art, however, that hydraulic line 68 could be alternately routed in any of a variety of satisfactory ways. For example, hydraulic line 68 could be routed laterally from probe 52 through a suitable cut-out provided between the ends of the legs to prevent it from being crushed, or could be routed into hydraulic cylinder 62 through its top.

External to probe 52, hydraulic line 68 is connected to pump 72 which pumps a hydraulic fluid drawn from a reservoir (not shown) into and out from hydraulic cylinder 62 through hydraulic line 68. The flow of the hydraulic fluid through hydraulic line 68 is controlled by valve 73. If desired, valve 73 may also connect hydraulic line 68 to a drain line (not shown).

That portion of hydraulic cylinder 62 which is not filled with the hydraulic fluid is filled with a column of compressible gas 74. The compressible gas is conducted into and out from hydraulic cylinder 62 by means of compressible gas line 76. Compressible gas line 76 is connected at one end to the interior of hydraulic cylinder 62 by connector 77 and at its other to a suitable reservoir (not shown). In the preferred embodiment of the present invention, the compressible gas is air and compressible gas line 76 may desirably lead to the open atmosphere rather than to a separate reservoir. The flow of the compressible gas into and out from hydraulic cylinder 62 through compressible gas line 76 is controlled by valve 78. Compressible gas line 76 extends down through downwardly extending leg 28 between deck 50 and hydraulic cylinder 62 through elongate central tube 80. In the preferred embodiment of the present invention, central tube 80 comprises a suitable length of high strength pipe with a polished external surface. At its lower end, central tube 80 is fixed to the top of hydraulic cylinder 62. At its upper end, which passes through and extends above deck 50, central tube 80 is provided with a shoulder 82 and an end cap 83 which extend radially beyond the outer diameter of central tube 80. Bushing 84 is fixed on deck 50, and positioned about central tube 80 between shoulder 82 and deck 50. Bushing 84 provides a centralizing bearing surface through which central tube 80 can slide, and also acts as a stop which reacts with shoulder 82 on central tube 80 to suspend hydraulic cylinder 62 and probe 52 in downwardly extending leg 28 against the force of gravity. In the preferred embodiment, bushing 84 is constructed as a deformable elastomeric ring.

Central tube 80 is rigidly connected to the top of hydraulic cylinder 62. Probe 52 is designed to move only axially relative to hydraulic cylinder 62. Therefore, if stabbing point 54 on probe 52 is pushed sideways, as by impact with the top of upwardly extending leg 36, probe 52 and hydraulic cylinder 62 avoid being damaged by pivoting as a unit about deformable elastomeric bushing 84. Adequate room is provided between hydraulic cylinder 62 and the inner wall of downwardly extending leg 28 to accommodate this movement.

Between hydraulic cylinder 62 and deck 50, and hence in series with hydraulic cylinder 62, is positioned a suitable linear spring 63. In the preferred embodiment illustrated in FIG. 2, such spring comprises a plurality of annular elastomeric discs 86 arranged about central tube 80 inside downwardly extending leg 28. The polished external surface of central tube 80 allows central tube 80 to slide freely through the open centers of elastomeric discs 86 as the discs are compressed between hydraulic cylinder 62 and deck 50. In a typical application, such an elastomeric spring may have a stiffness of about 500,000 lbs/ft.

As illustrated in FIG. 2, the system according to the present invention is shown with probe 52 suspended in hydraulic cylinder 62 with shoulder 61 on its upper end being positioned along cylinder 62 well above the lower stop provided by bushing 66. As discussed in more detail below, probe 52 can be suspended in such a position when the difference between the pressure of the compressible gas 74 in hydraulic cylinder 62 and the pressure of the external atmosphere, multiplied by the cross-sectional area of hydraulic cylinder 62, equals the weight of probe 52.

It will be appreciated that the system of the present invention, as illustrated in FIG. 2, represents essentially two springs acting in series on probe 52. One spring, the stack of elastomeric discs 86, possesses a linear compressive response; the other spring, hydraulic cylinder 62, possesses compressive response characteristics which may be varied by varying the amounts of compressible gas and hydraulic fluid contained in the cylinder.

It should also be noted that it would be obvious to one skilled in the art to modify the system of the present invention by reversing the order of the two springs, in other words, to arrange the system with hydraulic cylinder 62 above elastomeric discs 86, if so desired.

With reference now to FIGS. 3A–F, the sequential steps of the method of practicing the preferred embodiment of the present invention will be illustrated.

In the offshore mating operation, integrated deck structure 10 is initially mounted on barge 12 for transportation to substructure 14. With reference again to FIG. 1, barge 12 is moved into position proximate upwardly extending legs 36 of substructure 14 with downwardly extending legs 28 carrying shock load absorbing means 30 in approximate vertical alignment with upwardly extending legs 36 having receptacles 48 mounted thereon. Barge 12 is secured to the extent possible by bumpers 46 of fender assembly 42 and anchor lines (not shown) from barge 12 to substructure 14.

Figures 3A, 3B, 3C, 3D, 3E, 3F:
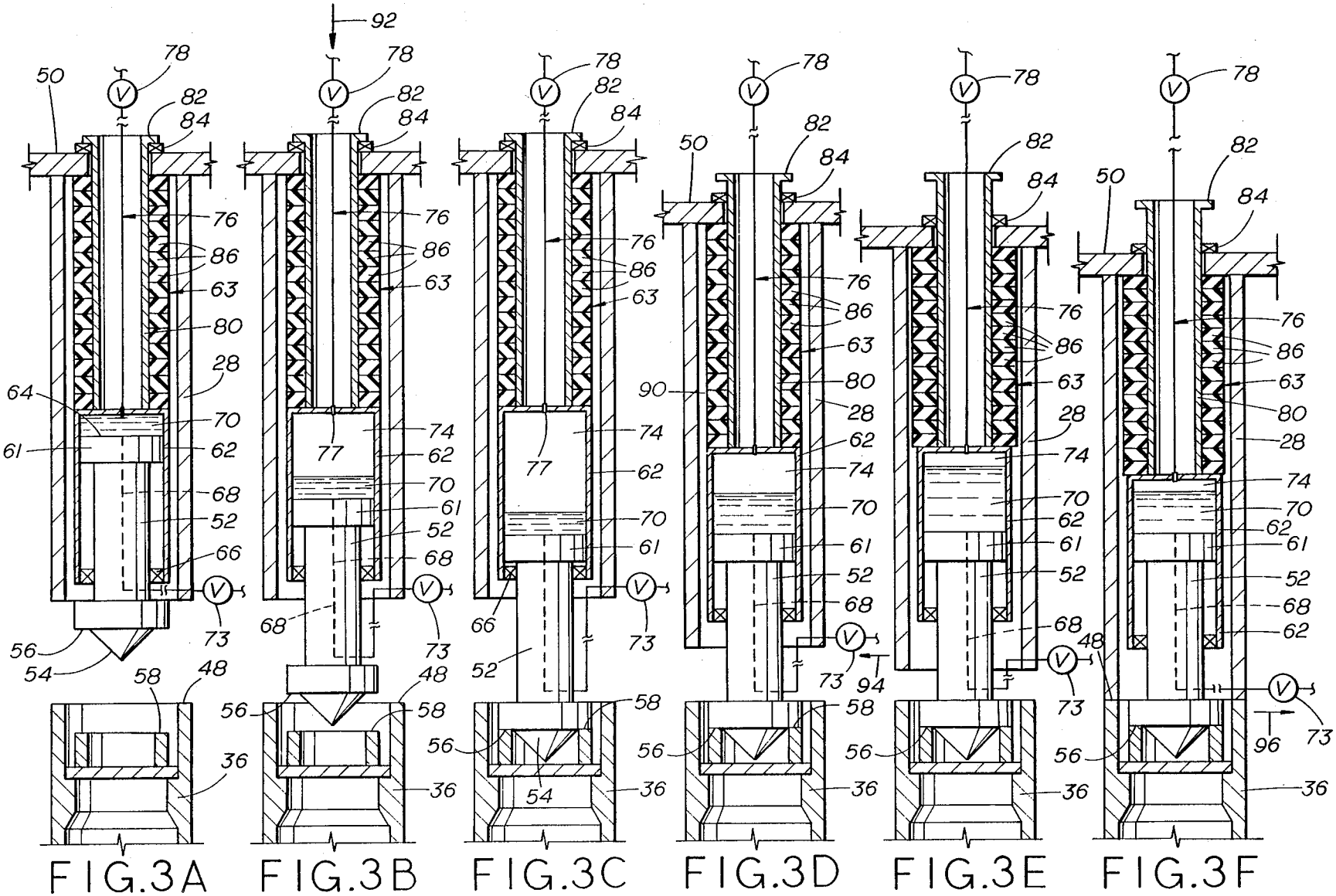
FIGS. 3A–F are a series of simplified cross-sectional elevation views similar to FIG. 2 showing the sequential steps of the mating procedure.

With reference to FIG. 3A, the system according to the present invention is shown with downwardly extending leg 28 held in approximate vertical alignment with upwardly extending leg 36 as described above. Probe 52 is suspended within hydraulic cylinder 62 with stabbing point 54 in approximate vertical alignment with tubular bearing surface 58. A small amount of a hydraulic fluid 70 is present in hydraulic cylinder 62, generating an effective hydraulic seal in conjunction with seal 64. Valves 73 and 78 are closed to prevent the flow of either hydraulic fluid or compressible gas into hydraulic cylinder 62, which, if either was permitted, would cause probe 52 to fall, The weight of probe 52 is quite large - on the order of 10,000 pounds in a typical application - and its tendency to move downward due to gravity results in a hydraulic pressure, in hydraulic cylinder 62, which is less than atmospheric. Probe 52 is held in vertical equilibrium when the probe weight is equal to the difference in pressure between that of the atmosphere, acting upwardly on the probe, and that in the hydraulic cylinder, acting downwardly on the probe, multiplied by the cylinder's cross-sectional area. Hydraulic cylinder 62 is in turn suspended in downwardly extending leg 28 by central tube 80, shoulder 82 of which is stopped above deck 50 by bushing 84. Central tube 80 is consequently under a tensile load. Disposed between deck 50 and hydraulic cylinder 62 is linear spring 63, composed of elastomeric discs 86, which, depending on the nature of its installation, may also be under tension in the situation illustrated in FIG. 3A.

With reference now to FIG. 3B, once barge 12 and substructure 14 have been secured as previously described, with downwardly extending leg 28 and probe 52 in approximate alignment with upwardly extending leg 36 and tubular bearing surface 58, valve 78 is opened slowly and the relative low pressure in hydraulic cylinder 62 draws in compressible gas through compressible gas line 76 in the direction indicated by arrow 92. As the compressible gas used in the preferred embodiment of the present invention is air, the term "air" will be used interchangeably with the term "compressible gas" throughout the remainder of the description of the invention. In the preferred embodiment illustrated, compressible gas line 76 leads directly to the surrounding atmosphere. The air drawn in through compressible gas line 76 results in an air column 74 filling that portion of hydraulic cylinder 62 which is not filled with the hydraulic fluid column 70.

As air is drawn into the cylinder, the above-described equilibrium state which caused probe 52 to be suspended in hydraulic cylinder 62 is disrupted and, as the probe weight now exceeds the difference in pressure between that of the atmosphere and that in hydraulic cylinder 62, multiplied by the cross-sectional area of the cylinder, the probe slowly drops due to the effect of gravity. As the probe drops, the volume in hydraulic cylinder 62 increases and maintains the low pressure, drawing in more air through compressible gas line 76.

Eventually, as illustrated in FIG. 3C, probe 52 drops until stabbing point 54 contacts tubular bearing surface 58. Stabbing point 54 reacts with tubular bearing surface 58 to align the lower end of probe 52 with tubular bearing surface 58. Probe 52 continues to drop until bearing ring 56 contacts tubular bearing surface 58.

For the reasons detailed above, it is important that the spring provided by the shock load absorbing system be as soft as possible when bearing ring 56 contacts tubular bearing surface 58. In the system of the present invention, the stiffness of the spring provided by hydraulic cylinder 62 when the contact is made, as illustrated in FIG. 3C, is given by the equation $$K = \frac{pA}{L} \tag{1}$$

where p is the pressure of the compressible gas in hydraulic cylinder 62, A is the cross-sectional area of hydraulic cylinder 62, L is the length of air column 74 in the vertical direction, and K is the resulting stiffness. The smaller p is, and the larger L is, the smaller K becomes. At the moment bearing ring 56 on stabbing point 54 contacts tubular bearing surface 58, the pressure (p) is significantly below atmospheric pressure. The length of the air column (L), in turn, is quite large, since probe 52 has reached the lowest point of its travel in hydraulic cylinder 62. The stiffness (K) is thus very small and the contact occurs with minimal shock loading.

After load bearing ring 56 has come into contact with tubular bearing surface 58, valve 78 is kept open and air continues to be drawn into hydraulic cylinder 62 through compressible gas line 76. As probe 52 is no longer descending, however, the pressure in hydraulic cylinder 62 gradually increases. As it does, the stiffness of the spring provided by hydraulic cylinder 62 increases in accordance with equation (1) set forth above. Eventually, the pressure inside hydraulic cylinder 62 reaches atmospheric and air ceases to be drawn in. Since there is at this point no longer any difference between the pressure in hydraulic cylinder 62 and that of the external atmosphere, hydraulic cylinder 62 no longer acts to suspend probe 52. The full weight of probe 52 consequently now rests on tubular bearing surface 58 on upwardly extending leg 36, and the possibility of separation between the probe and the upwardly extending leg due to deck heave is thus virtually eliminated.

With reference now to FIG. 3D, the next step of the method for practicing the present invention will be described. Valve 78 is closed to prevent the flow of air out from hydraulic cylinder 62. Valve 73 is then opened and a hydraulic fluid pumped rapidly into hydraulic cylinder 62 by pump 72 through hydraulic line 68 in the direction indicated by arrow 94. As the hydraulic fluid column 70 fills upward in hydraulic cylinder 62, it compresses the column of air 74 in the cylinder, thereby increasing the stiffness of the spring provided by the cylinder. Simultaneously, barge 12 is ballasted, lowering deck 50 with respect to offshore substructure 14 and probe 52. Consequently, both linear spring 63 and the air in hydraulic cylinder 62 are being simultaneously compressed between (1) the rising volume of hydraulic fluid 70 in hydraulic cylinder 62, and (2) sinking deck 50. The deck load of integrated deck structure 10 is thus being picked up by linear spring 63, transferred to the spring provided by the air in hydraulic cylinder 62 and from there through probe 52 to tubular bearing surface 58 and upwardly extending leg 36 of substructure 14.

Eventually, as is shown in FIG. 3E, the entire load of integrated deck structure 10 is assumed by linear spring 63 and the air column 74 in hydraulic cylinder 62. The pumping of hydraulic fluid is stopped and valve 73 is closed to prevent any flow of the hydraulic fluid into or out from the hydraulic cylinder.

It will be observed with reference to FIG. 3E that the downwardly extending leg 28 of integrated deck structure 10, while now lower than at the beginning of the mating process, is not yet itself in contact with the upwardly extending leg 36 of substructure 14. The size of this gap is determined primarily by the height of the column of hydraulic fluid 70 which was pumped into hydraulic cylinder 62 as air column 74 was compressed. The rate at which the hydraulic fluid is pumped into hydraulic cylinder 62 is selected to produce a hydraulic column 70 adequate in length to prevent downwardly extending leg 28 from colliding with upwardly extending leg 36 when the shock load absorbing system is fully compressed under the load of integrated deck structure 10. In this condition, any vertical oscillations of integrated deck structure 10 are absorbed by expansion and compression of the air column and linear spring, while the vertical gap provided by the hydraulic column serves to prevent impact between the two legs due to such oscillations.

With reference to FIG. 1, once the full load of integrated deck structure 10 has been assumed by linear spring 63 and air column 74, barge 12 can be disconnected from the underside of platform deck 16. It may be desired, however, that, in view of the then prevailing sea state or the buoyancy characteristics of barge 12, some minor portion of the load of integrated deck structure 10 remain on barge 12 until its actual disengagement. Once at least the desired major portion of the load has been transferred, drop block assemblies 32 are disconnected from load bearing pads 34 to transfer any remaining load of integrated deck structure 10 to substructure 14. Activation of the drop block assemblies 32 creates an immediate gap between substructure 14 and barge 12. This gap provides sufficient clearance to prevent barge 12 from colliding with substructure 14 under the heaving influence of wave action. Once disconnected, barge 12 is returned to shore.

Once the load of integrated deck structure 10 has been completely transferred to substructure 14, and barge 12 disconnected, downwardly extending leg 28 is lowered into contact with upwardly extending leg 36 as illustrated by FIG. 3F. With reference to FIG. 3F, valve 73 is opened and hydraulic fluid is allowed to slowly escape out from hydraulic cylinder 62 through hydraulic line 68 in the direction indicated by arrow 96, either to a drain line or back to the reservoir from which it was initially drawn. As the hydraulic fluid is released, the length of the hydraulic fluid column 70 remaining in hydraulic cylinder 62 slowly decreases, allowing deck 50 and downwardly extending leg 28 to slowly descend due to gravity. Deck 50 and downwardly extending leg 28 continue to descend until the lower end of downwardly extending leg 28 contacts the upper end of upwardly extending leg 36. When contact is made between the legs, the upwardly extending leg 36 will begin to assume the load of integrated deck structure 10, which is until then carried by the springs. As the hydraulic fluid continues to escape from hydraulic cylinder 62, both the linear spring 63 and the air in hydraulic cylinder 62 are relieved of the load of integrated deck structure 10 and expand. If desired, valve 78 may also be opened during this time to allow air from air column 74 to escape from hydraulic cylinder 62, through compressible gas line 76, thus increasing the rate of load transfer. If valve 78 is used to release the air from hydraulic cylinder 62, the still expanding linear spring 63 will also push some of the hydraulic fluid out through compressible gas line 76 once all the air has escaped. Eventually, the pressure in hydraulic cylinder 62 drops to atmospheric and the full load of integrated deck structure 10 is transmitted directly through downwardly extending deck leg 28 to upwardly extending leg 36 of substructure 14. The ends of the legs are then welded together to provide a more rigid final structure.

With the pressure in hydraulic cylinder 62 at atmospheric, the shock load absorbing system is returned to the original condition and does not carry any of the load of integrated deck structure. The system can, if desired, then be withdrawn from the top of downwardly extending leg 28 and reused.

To this point the description of the system of the present invention has concerned a single unit. For integrated deck structures and substructures having a plurality of legs, a shock absorbing means would preferably be associated with each corresponding pair of legs, and the above described sequential steps would be performed simultaneously for all of these shock absorbing means so as to maintain a level deck throughout the mating operation.

Figure 4A:
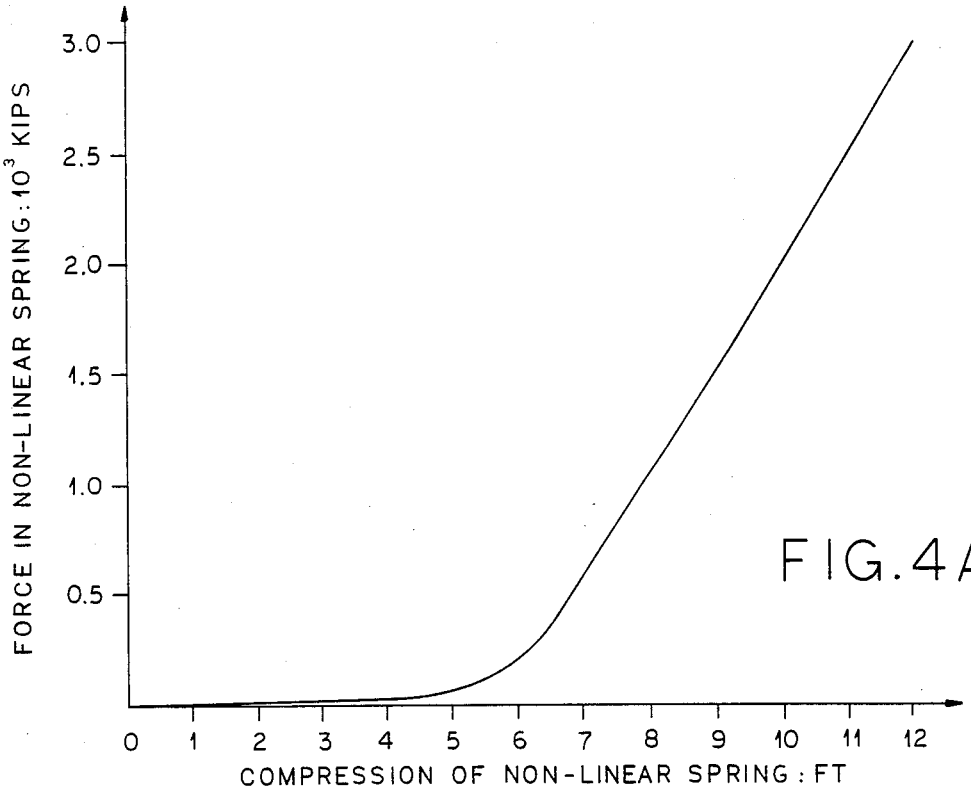
FIG. 4A is a graphical representation of the load response of the system of FIG. 2 as the system is compressed.
Figure 4B:
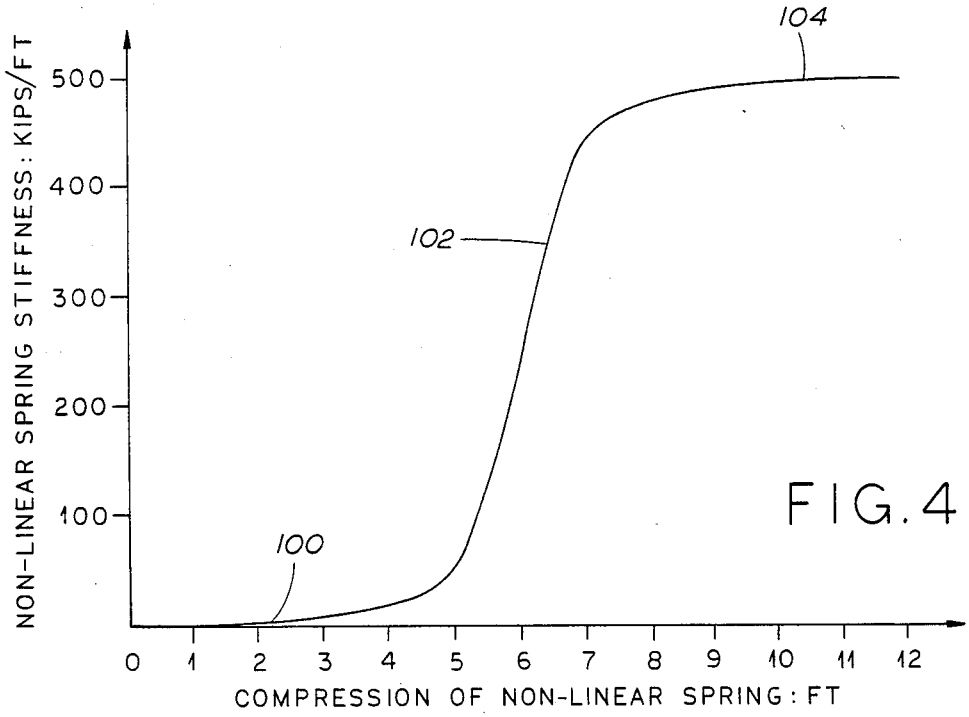
FIG. 4B is a graphical representation of the spring stiffness response of the system of FIG. 2 as the system is compressed.

With reference now to FIGS. 4A and 4B, the stiffness and load responses of the system of the present invention will be described. The curves shown in FIGS. 4A and 4B illustrate the desirable non-linear response characteristics exhibited by the load shock absorbing system when compressed in the previously described sequence. These characteristics enable the smooth transfer of the load of integrated deck structure 10 to substructure 14 with minimal shock loading.

FIG. 4A illustrates the load response of the system, in terms of force in the springs, as it is compressed.

As is known to those skilled in the art, for two springs arranged in series the force in one is equal to the force in the other, and to the force in the overall series. Thus, in the system of the present invention, $F_T = F_A = F_E$, wherein $F_A$ is the force in the air column, $F_E$ is the force in the linear elastomeric spring, and $F_T$ is the force in the overall series. $F_A$, and therefore $F_T$, can be determined from the equation $$F_A = P_1 A \frac{L_1}{(L_1 - X_A)} = F_T \quad (2)$$

which can be derived by those skilled in the art from known principles and wherein A is the cross-sectional area of hydraulic cylinder 62, $P_1$ is the pressure of the air in the hydraulic cylinder of the beginning of compression, $L_1$ is the length of the air column at the beginning of compression, and $X_A$ is the amount the air column is compressed. Equation (2) was used to determine force in the system for FIG. 4A, based on an example system wherein the hydraulic cylinder has a 36 inch diameter and hence $A \simeq 1{,}018$ in$^2$; the probe has a weight of 10,000 lbs and hence $P_1 = 4.88$ psi, calculated from the equilibrium relationship described above (i.e., the probe is in vertical equilibrium when its weight is equal to the pressure differential between atmospheric and $P_1$ multiplied by the cross-sectional area of the cylinder); and the probe starts with its bearing ring 6 ft above the tubular bearing surface and hence $L_1 = 72$ in.

The total compression of the system, air column and linear elastomeric spring combined, was determined for FIG. 4A from the equation $$X_T = X_A + \frac{P_1 A}{K_E} \cdot \frac{L_1}{L_1 - X_A} \quad (3)$$

which can be derived by one skilled in the art from known principles, and in which $X_A$, A, $P_1$, and $L_1$ represent the same factors as above, $K_E$ is the stiffness of the linear elastomeric spring used in the system, which is assumed to be 500,000 lb/ft or 41,667 lb/in the example, and $X_T$ is the total amount the system is compressed. Equation (2), giving total force, was used in combination with equation (3), giving total compression, to determine the load response curve in FIG. 4A.

FIG. 4B illustrates the stiffness response of the system as it is compressed.

The stiffness of the total system can be determined from the equation $$K_T = \frac{P_1 A L_1 K_E}{(L_1 - X_A)^2 K_E + P_1 A L_1} \quad (4)$$

which can be derived by those skilled in the art from known principles, and in which $P_1$, A, $L_1$, $X_A$, and $K_E$ represent the same factors as above and $K_T$ is the stiffness of the total system. Equation (4), giving total stiffness, was used in combination with equation (3), giving total compression, to determine the stiffness response curve in FIG. 4B.

With reference to that portion of the curve in FIG. 4B which is indicated by reference numeral 100, it will be observed that the stiffness of the shock load absorbing system is very small at the moment of contact between bearing ring 56 and tubular bearing surface 58. At this moment, and before any compression has occurred, probe 52 has just been descending in hydraulic cylinder 62, and thereby, as described above, has created very low pressure in hydraulic cylinder 62. In the example system with, as previously described, a hydraulic cylinder 62 having an inside diameter of 36 inches and a probe 52 weighing 10,000 lbs which starts with its bearing ring at a point 6 feet above the tubular bearing surface, the stiffness of the system at first contact can be calculated to be equal to 828 lb/ft, or 69 lb/in, which is an extremely small value.

As pressure in hydraulic cylinder 62 continues to rise to atmospheric due to the continued inflow of air through valve 78 and line 76, the stiffness of the system increases. The stiffness of the above example system will have increased to 2482 lb/ft by the time the pressure in the cylinder reaches atmospheric and valve 78 is closed.

As next the hydraulic fluid is pumped into the cylinder while the barge is simultaneously ballasted, compression of the entire non-linear spring system begins. The rapid rate of stiffness increase can be seen in that portion of the curve in FIG. 4B which is indicated by reference numeral 102. The stiffness of the above example system increases slowly until a compression of about 5 feet is reached, and then, between 5 and 7 feet of compression, it rises rapidly. After about 7 feet of compression, the stiffness of the system asymptotically approaches that of the linear elastomeric spring, which, as previously described, is assumed to be 500,000 lb/ft in the example, as is seen in that portion of the curve which is indicated by reference numeral 104. The rate of stiffness increase in the system can be variably controlled as desired by controlling the rates at which hydraulic fluid is pumped into the cylinder and the barge is ballasted.

By the time the example non-linear spring system has assumed the entire load of integrated deck structure 10, which is assumed to be 3,000,000 pounds for the example, the air spring has been compressed to a very small volume and can be calculated to have a length of only about $\frac{1}{3}$ of an inch. The example elastomeric linear spring has itself been compressed about 6 feet during the load transfer.

The load-transfer system of the present invention provides an effective means for mating integrated deck structures with offshore substructures, while minimizing shock loading. The system provides a shock absorbing means which is very soft upon initial impact, but which quickly becomes very stiff upon compression and thus quickly assumes the load of the integrated deck structure with minimal shock loading and a reasonably short amount of vertical deflection.

Inasmuch as the present invention is subject to a great many variations, modifications, and changes in detail, it is intended that all subject matter discussed above and shown in the accompanying drawings be interpreted as illustrative and not in a limiting sense. For example, it would be obvious to one skilled in the art to reverse the order of the two springs in series from that illustrated and thus mount the probe on an elastomeric spring below the hydraulic cylinder. Alternatively, it would be obvious to one skilled in the art to mount the system external to the legs of the integrated deck and substructure rather than inside them. Such variations, modifications, and changes in detail are included within the scope of the present invention as defined by the following claims.

What is claimed is:

1. A load transfer system for use in mating an integrated deck with an offshore platform substructure, said load transfer system comprising:

a probe extending downwardly from said integrated deck and having a lower end with a first load bearing surface formed thereon;

shock-load absorbing means mounted between said integrated deck and said probe, said shock-load absorbing means comprising, in series, a first spring having a linear compressive response and a second spring having a variable compressive response, said second spring including:

a hydraulic cylinder;

means for conduction a hydraulic fluid into and out from said hydraulic cylinder; and means for conducting a compressible gas into and out from said hydraulic cylinder; and a second load bearing surface forced on said offshore platform substructure, said second load bearing said first load bearing surface when said probe is lowered into contact with said offshore platform substructure.

2. The system of claim 1, wherein said first spring is an elastomeric spring.

3. The system of claim 2 wherein said elastomeric spring comprises a plurality of elastomeric discs arranged in series.

4. The system of claim 1, wherein said compressible gas is air.

5. The system of claim 4, wherein said means for conducting said compressible gas into and out from said hydraulic cylinder comprises:

an air line connecting the interior of said hydraulic cylinder to the atmosphere; and a valve for controlling the flow of air through said air line.

6. The system of claim 1, wherein said means for conducting a hydraulic fluid into and out from said hydraulic cylinder comprises:

a hydraulic line connecting the interior of said hydraulic cylinder to a reservoir containing said hydraulic fluid;

a valve for controlling the flow of said hydraulic fluid through said hydraulic line;

a pump for pumping said hydraulic fluid from said reservoir into said hydraulic cylinder through said hydraulic line; and means for releasing said hydraulic fluid out from said hydraulic cylinder.

7. A load transfer system for use in mating an integrated deck with an offshore platform substructure, said integrated deck having at least one downwardly extending leg matable with a corresponding upwardly extending leg of said offshore platform substructure, said load transfer system comprising:

shock-load absorbing means mounted in each said downwardly extending leg of said integrated deck structure, said shock-load absorbing means comprising, in series, a linear spring and a hydraulic cylinder;

a probe extending into and being axially slideable with respect to each said hydraulic cylinder, said probe having an upper end adapted to form a piston within said hydraulic cylinder and a lower end extending downwardly from said hydraulic cylinder and having a first load bearing surface formed thereon;

means for conducting a hydraulic fluid into and out from each said hydraulic cylinder;

means for conducting a compressible gas into and out from each said hydraulic cylinder; and a second load bearing surface formed in each said upwardly extending leg of said offshore platform substructure, said second load bearing surface corresponding to and adapted to mate with said first load bearing surface when said probe is lowered into said upwardly extending leg of said offshore platform substructure.

8. The system of claim 7, wherein said compressible gas is air.

9. The system of claim 8, wherein said means for conducting said compressible gas into and out from said hydraulic cylinder comprises:

an air line connecting the interior of said hydraulic cylinder to the atmosphere; and a valve for controlling the flow of air through said air line.

10. The system of claim 9, wherein said means for conducting a hydraulic fluid into and out from said hydraulic cylinder comprises:

a hydraulic line connecting the interior of said hydraulic cylinder to a reservoir containing said hydraulic fluid;

a valve for controlling the flow of said hydraulic fluid through said hydraulic line;

a pump for pumping said hydraulic fluid from said reservoir into said hydraulic cylinder through said hydraulic line; and means for releasing said hydraulic fluid out from said hydraulic cylinder.

11. The system of claim 7, wherein said linear spring is an elastomeric spring.

12. The system of claim 11, wherein said elastomeric spring comprises a plurality of elastomeric discs arranged in series.

13. The system of claim 7, wherein said load bearing surface formed in said upwardly extending leg of said offshore substructure is a tubular bearing surface.

14. The system of claim 13, wherein said load bearing surface formed on said lower end of said probe is a circular load bearing ring.

15. A load transfer system for use in mating an integrated deck with an offshore platform substructure, said integrated deck having at least one downwardly extending leg matable with a corresponding upwardly extending leg of said offshore platform substructure, said load transfer system comprising:

a hydraulic cylinder in each said downwardly extending leg, said hydraulic cylinder having a substantially vertical axis;

an elongate tube mounted on the upper end of, and substantially coaxially with, each said hydraulic cylinder, said elongate tube extending upwardly to said integrated deck;

deformable means for suspending each said elongate tube from said integrated deck;

a plurality of elastomeric discs mounted in series about each said elongate tube intermediate said upper end of said hydraulic cylinder and said integrated deck;

a probe extending into and being axially slideable with respect to each said hydraulic cylinder, said probe having an upper end adapted to form a piston within said hydraulic cylinder, and a lower end extending downwardly from said hydraulic cylinder, said lower end having a first load bearing surface formed thereon;

means for conducting a hydraulic fluid into and out from each said hydraulic cylinder;

means for conducting a compressible gas into and out from each said hydraulic cylinder; and a second load bearing surface formed in each said upwardly extending leg of said offshore substructure, said second load bearing surface corresponding to and adapted to mate with said first load bearing surface when said probe is lowered into said upwardly extending leg of said offshore platform substructure.

16. The system of claim 15, wherein said compressible gas is air.

17. The system of claim 16, wherein said means for conducting said compressible gas into and out from said hydraulic cylinder comprises:

an air line connecting the interior of said hydraulic cylinder to the atmosphere; and a valve for controlling the flow of air through said air line.

18. The system of claim 17, wherein said air line is routed to said hydraulic cylinder through said elongate tube mounted thereon.

19. The system of claim 17, wherein said means for conducting a hydraulic fluid into and out from said hydraulic cylinder comprises:

a hydraulic line connecting the interior of said hydraulic cylinder to a reservoir containing said hydraulic fluid;

a valve for controlling the flow of said hydraulic fluid through said hydraulic line;

a pump for pumping said hydraulic fluid from said reservoir into said hydraulic cylinder through said hydraulic line; and means for releasing said hydraulic fluid out from said hydraulic cylinder.

20. The system of claim 19, wherein said load bearing surface formed in said upwardly extending leg of said offshore substructure is a tubular bearing surface.

21. The system of claim 20, wherein said load bearing surface formed on said lower end of said probe is a circular load bearing ring.

22. A method for mating an integrated deck with an offshore platform substructure, said method comprising the steps of:

positioning said integrated deck on a barge proximate said substructure so that an at least one first load bearing surface mounted on said substructure is in approximate vertical alignment below an at least one second load bearing surface adapted to mate with said first load bearing surface and mounted on the lower end of a probe extending downwardly from shock-load absorbing means attached to said integrated deck, said shock-load absorbing means comprising, in series, (a) a first spring having a linear compressive response and (b) a second spring having a variable compressive response, said second spring including:

a hydraulic cylinder;

means for conducting a hydraulic fluid into and out from said hydraulic cylinder;

and means for conducting a compressible gas into and out from said hydraulic cylinder;

lowering said second load bearing surface into contact with said first load bearing surface;

increasing the stiffness of said spring by conducting said hydraulic fluid into said hydraulic cylinder while preventing the flow of said compressible gas out from said hydraulic cylinder, whereby said compressible gas in said hydraulic cylinder is compressed; and lowering said integrated deck, whereby at least a portion of the load of said integrated deck is transferred from said barge to said substructure.

23. The method of claim 22, wherein said step of lowering said second load bearing surface into contact with said first load bearing surface comprises conducting said compressible gas into said hydraulic cylinder.

24. The method of claim 22, further comprising the subsequent step of disengaging said barge from said integrated deck when the desired portion of said load of said integrated deck has been transferred to said substructure, whereby the remaining load of said integrated deck is transferred to said substructure upon disengagement of said integrated deck from said barge.

25. The method of claim 22, wherein said step of lowering said integrated deck comprises the step of ballasting said barge.

26. The method of claim 22, wherein the step of conducting said hydraulic fluid into said hydraulic cylinder further comprises substantially continuously conducting said hydraulic fluid into said hydraulic cylinder as said integrated deck is lowered.

27. A load transfer system for use in mating an integrated deck with an offshore platform substructure, said load transfer system comprising:

a probe extending downwardly from said integrated deck and having a lower end with a first load bearing surface formed thereon;

shock-load absorbing means mounted between said integrated deck and said probe, said shock-load absorbing means comprising, in series, (a) a first spring having a linear compressive response and (b) a second spring having a compressive response which is adjustable during the transfer of the load of said integrated deck to said offshore platform substructure;

a second load bearing surface formed on said offshore platform substructure, said second load bearing surface corresponding to and adapted to mate with said first load bearing surface when said probe is lowered into contact with said offshore platform substructure.

28. The system of claim 28, wherein said second spring comprises:

a hydraulic cylinder;

means for conducting a hydraulic fluid into and out from said hydraulic cylinder; and means for conducting a compressible gas into and out from said hydraulic cylinder.

29. The system of claim 28, wherein said first spring is an elastomeric spring.

30. The system of claim 29, wherein said elastomeric spring comprises a plurality of elastomeric discs arranged in series.

31. The system of claim 29, wherein said compressible gas is air.

32. The system of claim 31, wherein said means for conducting said compressible gas into and out from said hydraulic cylinder comprises:

an air line connecting the interior of said hydraulic cylinder to the atmosphere; and a valve for controlling the flow of air through said air line.

33. The system of claim 29, wherein said means for conducting a hydraulic fluid into and out from said hydraulic cylinder comprises:

a hydraulic line connecting the interior of said hydraulic cylinder to a reservoir containing said hydraulic fluid;

a valve for controlling the flow of said hydraulic fluid through said hydraulic line;

a pump for pumping said hydraulic fluid from said reservoir into said hydraulic cylinder through said hydraulic line; and means for releasing said hydraulic fluid out from said hydraulic cylinder.

34. An integrated deck having a load transfer system mounted thereon for use in mating said integrated deck with an offshore platform substructure, said load transfer system comprising:

a probe extending downwardly from said integrated deck and having a lower end with a first load bearing surface formed thereon;

shock-load absorbing means mounted between said integrated deck and said probe, said shock-load absorbing means comprising, in series, a first spring having a linear compressive response and a second spring having a variable compressive response, said second spring including:

a hydraulic cylinder;

means for conducting a hydraulic fluid into and out from said hydraulic cylinder; and means for conducting a compressible gas into and out from said hydraulic cylinder; and a second load bearing surface formed on said offshore platform substructure, said second load bearing surface corresponding to and adapted to mate with said first load bearing surface when said probe is lowered into contact with said offshore platform substructure.

* * * * *